US009101526B2

(12) United States Patent
Nakamura

(10) Patent No.: US 9,101,526 B2
(45) Date of Patent: Aug. 11, 2015

(54) GAS MIST PRESSURE BATHING SYSTEM

(75) Inventor: Shoichi Nakamura, Higashichikuma-gun (JP)

(73) Assignees: ACP JAPAN CO., LTD., Tokyo (JP); Shoichi Nakamura, Higashichikuma-gun, Nagano (JP)

( * ) Notice: Subject to any disclaimer, the term of this patent is extended or adjusted under 35 U.S.C. 154(b) by 933 days.

(21) Appl. No.: 13/261,026

(22) PCT Filed: Jun. 29, 2011

(86) PCT No.: PCT/JP2011/064968

§ 371 (c)(1), (2), (4) Date: Nov. 17, 2011

(87) PCT Pub. No.: WO2012/002461

PCT Pub. Date: Jan. 5, 2012

(65) Prior Publication Data

US 2012/0157910 A1 Jun. 21, 2012

(30) Foreign Application Priority Data

Jul. 1, 2010 (JP) ..... 2010-150850

(51) Int. Cl.

*A61H 35/00* (2006.01)
*A61H 33/06* (2006.01)
*A61H 33/14* (2006.01)

(52) U.S. Cl.

CPC ..... *A61H 35/00* (2013.01); *A61H 33/06* (2013.01); *A61H 33/14* (2013.01); (Continued)

(58) Field of Classification Search

CPC ... A61G 10/02; A61G 10/023; A61G 10/026; A61H 33/02; A61H 33/14; A61H 33/141; A61H 33/143; A61H 33/145; A61H 33/146; A61H 33/148; A61H 35/00; A61H 35/002; A61H 35/004; A61H 35/006; A61H 35/008; A61H 2033/0004; A61H 2201/10; A61H 2201/105; A61H 2201/5058; A61H 2205/00–2205/12; A61H 2033/141; A61H 2033/143; A61H 2033/145; A61H 2033/146; A61H 2033/148; A61H 2035/004; A61H 2201/5071; A61H 2201/5082; A61M 35/00; A61M 37/00; A61M 2210/04; A61M 2210/08; A61M 2210/083; A61M 2210/086

USPC ..... 128/202.12, 202.26; 604/24, 289, 290, 604/293, 305, 308

See application file for complete search history.

(56) References Cited

U.S. PATENT DOCUMENTS 3,908,704 A * 9/1975 Clement et al. ..... 138/121

(Continued)

FOREIGN PATENT DOCUMENTS

| | | |
|---|---|---|
| JP | H07-017189 | 7/1995 |
| JP | 3150690 U * | 4/2009 |
| WO | WO 2010/064643 | 6/2010 |
| WO | WO 2011/043106 | 4/2011 |

OTHER PUBLICATIONS

English Translation of JP 3150690 U. Provided by Applicant in co-owned U.S. Appl. No. 13/138,815.*

*Primary Examiner* — Kami A Bosworth

(74) *Attorney, Agent, or Firm* — Manabu Kanesaka

(57) ABSTRACT

A gas mist pressure bathing system for preparing a gas mist by pulverizing and dissolving a gas including carbon dioxide or oxygen or a mixed gas of carbon dioxide and oxygen, and a liquid, and causing the gas mist to directly contact skin and mucous membrane of a living organism, includes a gas supply device, a gas mist generating device having a liquid storage, a nozzle discharging the gas, and a liquid sucking pipe for sending the liquid to the nozzle, a covering member for covering the skin and mucous membrane, sensors, and a control device. The gas mist generating device further includes a gas introduction device for supplying the gas into the gas mist generating device, and generating an air current guiding the gas mist to the covering member to increase supplying pressure of the gas mist into the covering member.

20 Claims, 15 Drawing Sheets

(52) U.S. Cl.
CPC .... *A61H 2033/143* (2013.01); *A61H 2033/145* (2013.01); *A61H 2201/0207* (2013.01); *A61H 2201/5071* (2013.01); *A61H 2201/5082* (2013.01); *A61H 2205/06* (2013.01); *A61H 2205/065* (2013.01); *A61H 2205/10* (2013.01); *A61H 2205/108* (2013.01); *A61H 2205/12* (2013.01)

(56) References Cited

U.S. PATENT DOCUMENTS

| | | | | | |
|---|---|---|---|---|---|
| 3,936,698 | A * | 2/1976 | Meyer | ..... | 361/231 |
| 5,848,998 | A * | 12/1998 | Marasco, Jr. | ..... | 604/290 |
| 7,276,051 | B1 * | 10/2007 | Henley et al. | ..... | 604/304 |

* cited by examiner

GAS MIST PRESSURE BATHING SYSTEM

RELATED APPLICATIONS

The present application is National Phase of International Application No. PCT/JP2011/064968 filed Jun. 29, 2011, and claims priority from Japanese Application No. 2010-150850, filed Jul. 1, 2010.

TECHNICAL FIELD

The present invention relates to a gas mist pressure bathing system, in which a gas mist is prepared by pulverizing and solving a liquid containing carbon dioxide or oxygen and a medicine, otherwise the mixed gas of carbon dioxide and oxygen and the medicine, and is caused to directly contact the skin and mucous membrane of the living organism, thereby to improve absorption efficiency of the gas mist into the skin and mucous membrane.

BACKGROUND ART

Conventionally, it has been known that carbon dioxide (carbonic acid anhydride: $CO_2$) has two properties of being not only soluble in water (water-soluble) but also soluble in fat (fat-soluble) and, therefore, when contacting the skin and mucous membrane of the living organism having the two properties of water and fat, carbon dioxide well penetrates under a subcutaneous layer and expands blood vessels around the parts of penetrated carbon dioxide, and it works to improve the blood circulation. By the action of carbon dioxide accelerating the blood circulation, it displays various physiological effects such as dropping of blood pressure, improving of metabolism or accelerating to remove pain substance or waste product. Further, it has also anti-inflammation and anti-bacterial. Therefore, carbon dioxide has recently been given attentions also from viewpoints of improving health or beauty other than the purpose of medical cares.

Carbon dioxide further works to release oxygen having been carried in combination with hemoglobin in a red blood cell in the tissue of the living organism. Around parts at the high density of carbon dioxide, the red blood cell releases more oxygen. Thus, supply of oxygen to cells by the red blood cell is mainly controlled by carbon dioxide. In short, being without carbon dioxide, hemoglobin remains as having been combined with oxygen and the cell becomes unable to receive oxygen. As is seen, carbon dioxide seems to be waste products resulted from action of the cell, however, it plays in fact very important roles in the living organism.

Further, recently, oxygen of the high density has also widely been known as effective in activity of metabolism, acceleration of blood circulation, fatigue recovery, or stability of blood pressure. Other than them, oxygen has effects of disinfection or sterilization by oxidation.

As a prior art for causing carbon dioxide to be absorbed into the living organism, a most broadly used technique is (1) a bathing agent generating carbon dioxide in water. Throwing this bathing agent into hot water in a bathtub, it generates carbon dioxide by reacting carbonate and acid contained in the bathing agent, and dissolves carbon dioxide in hot water. Carbon dioxide dissolved in hot water contacts the skin of a bathing person and penetrates his/her subcutaneous layer to display physiological effects as above mentioned.

As the prior art for causing more carbon dioxide to contact the living organism, (2) a carbon dioxide bathing device has been known. This emits and disperses carbon dioxide in hot water and dissolves it at the high density. When bathing in hot water having dissolved carbon dioxide, the skin directly contacts it in the same as the above mentioned bathing agent.

A blood circulation accelerating device (for example, Patent Document 1 under mentioned) has now been disclosed, which (3) attaches a cover to the human living organism, forming a sealed space together with the surface of the living organism, and introduces carbon dioxide into the sealed space from a carbon dioxide supply means for carrying out a carbon dioxide bathing.

A carbon dioxide pressure bathing device, which is equipped with at least (4) the carbon dioxide supply means, a pressurizing means, and a covering material for covering the living organism's skin and causing carbon dioxide to contact the skin at pressure of not less than predetermined value, has been proposed by an inventor of the present invention.

As the prior art for causing oxygen to be absorbed into the living organism, (5) a high density oxygen bathing device has been known. Being similar to the carbon dioxide bathing device, this emits and disperses oxygen dioxide in hot water, in which taking a bath, oxygen is caused to directly contact the skin.

CITATION LIST

Patent Literature

Patent Document 1: Japanese Patent Application Publication No. 07-171189

SUMMARY OF INVENTION

Technical Problem

However, each of the above prior arts (1), (2) and (5) dissolves carbon dioxide or oxygen in hot water when taking the bath, and causes carbon dioxide, oxygen and others to be absorbed into the skin of the living organism. Accordingly, they were involved with difficult points of serving each of them only when taking the bath. In addition, since carbon dioxide is easily dissolved in water and easily dispersed from water, and even if much consuming it for dissolving in hot water, an absorption rate into the skin is never much high.

On the other hand, since the above prior arts (3) and (4) cause carbon dioxide to directly contact the living organism and if comparing with the prior arts (1) and (2), effects are high and efficiency is good. But these have not optimized to control the amounts or pressures of carbon dioxide, oxygen and the mist to be introduced into the shielding member (cover).

Further, up to now, there has not been such a device which efficiently dissolves a medicine in carbon dioxide or oxygen and effectively influences a physiological action of the medicine to the living organism in addition to gas.

In view of the above mentioned circumstances, it is an object of the invention to provide a gas mist pressure bathing system which is possible to control the amounts, pressures and others of gas and liquid, and cause the gas mist to be absorbed through the skin and mucous membrane of the human living organism under an optimum condition.

Solution of Problem

For solving the above mentioned problems, the present invention is to propose such a gas mist pressure bathing system, which prepares a mist (called as "gas mist" hereafter) by pulverizing and dissolving carbon dioxide or oxygen and a liquid, otherwise the mixed gas (called briefly as "gas"

hereafter) of carbon dioxide and oxygen and the liquid, and causes the mist to directly contact the skin and mucous membrane of the living organism at a density of not less than a predetermined value, and which has gas supply means; gas mist generating means for generating the gas mist, connected to the gas supply means, and having a liquid storage storing the liquid, a nozzle for supplying under pressure the gas, and a liquid sucking pipe for sending the liquid to the front end of the nozzle; a covering member for the living organism covering the skin and mucous membrane of the living organism and formed with a space for sealing inside the gas mist supplied from the gas mist generating means; sensors for measuring supplying conditions the gas, liquid and gas mist; and control means for controlling supplying conditions of the gas, liquid and gas mist based on the measuring values of the sensors, and which is characterized in that the gas mist generating means is further provided with a gas introduction means for supplying the gas into the gas mist generating means independently of the nozzle in order to heighten supplying pressure of the gas mist into the living organist covering member.

By the way, the invention refers it as "pulverizing and dissolving" to pulverize the liquid into fine liquid drops, and cause to contact and mix with gas (carbon dioxide or oxygen, otherwise, the mixed gas of carbon dioxide and oxygen).

Herein, the present gas mist pressure bathing system may have further pressurizing means for pressurizing the inside of the living organism covering member. By the way, this pressurizing means is connected to the living organism covering member and has a hollow gas storage enabling to discharge the gas mist into the living organism covering member.

It is sufficient to effect interval pressurization in the living organism covering member by supplying the gas mist on and off into the living organism covering member by means of the control means. Otherwise, it is also sufficient to effect interval pressurization in that the pressurizing means discharges the gas on and off into the living organism covering member.

It is preferable to further provide a liquid supply means for supplying the liquid to the liquid storage in the present gas mist pressure bathing system. Further on, it is also desirable to provide a liquid pressurizing means for pressurizing the liquid from the liquid supply means and supplying to the gas mist generating means.

At this time, it is desirable that the above mentioned liquid is any one or plural combination of water, ionic water, ozone water, physiological salt solution, purified water, or sterilized and purified water. Desirably, the above medicines are any one or plural combination of menthol, vitamin E, vitamin C derivative, retinol, anesthetic agent, cyclodextrin, photocatalyst, complex of photocatalyst and apatite, hyaluronic acid, coenzyme Q10, seed oil, propolith, ethanol, chlorhexidine gluconate, amphoteric surface active agent, benzalkonium chloride, alkyldiamino etherglycine acetate, sodium hypochlorite, peracetic acid, sodium sesquicarbonate, silica, povidone-iodine, sodium hydrogen carbonate, carbonate spring agent of high density, anti-allergic agent, anti-inflammatory agent, anti-febrile agent, anti-fungus agent, anti-influenza virus agent, influenza vaccine, steroid agent, anti-cancer agent, anti-hypertensive agent, and cosmetic.

A size of the mist supplied from the gas mist supply means into the living organism covering member is suitably not more than 10 μm.

The control means preferably holds pressure at 1.02 to 2.5 air pressure in the living organism covering member when taking pressure bath of the gas mist.

Further on, there may be provided an electric charge supply means for supplying charge to the mist from the gas mist supply means. At this time, the charge is preferably minus.

Desirably, the gas mist supply means has a gas mist supply pipe for supplying the gas mist into the living organism covering member, and this gas mist supply pipe is preferably furnished with a filter for removing liquid drops attaching to the inside of the pipe. Still further, the gas mist supply pipe is suitably composed of a cornice shaped pipe over a whole or at one part of the gas mist supply pipe. In addition, this gas mist supply pipe is provided with a check valve.

In addition, the gas mist supply port of the living organism covering member is also provided at its supply port with the check valve.

The control means desirably stops the gas from the gas supply means when the pressurizing value within the living organism covering member is higher than a predetermined value.

Preferably, the gas mist generating means is in advance sterilized.

Advantageous Effects of Invention

According to the gas mist pressure bathing system of the invention, since it is possible to control the amount and pressure of the gas mist existing in the pressure bathing cover by the control device, the gas mist pressure bathing can be always taken under the best condition.

In addition, since the gas mist can be generated by a very simple structure, the cost of the device can be reduced.

Pressurization within the pressure covering for the living organism is easy, so that skin-pass of gas can be efficiently realized.

DESCRIPTION OF EMBODIMENTS

In the following description, explanations will be made to the embodiments of this invention, referring to the attached drawings.

First Embodiment

Figure 1:
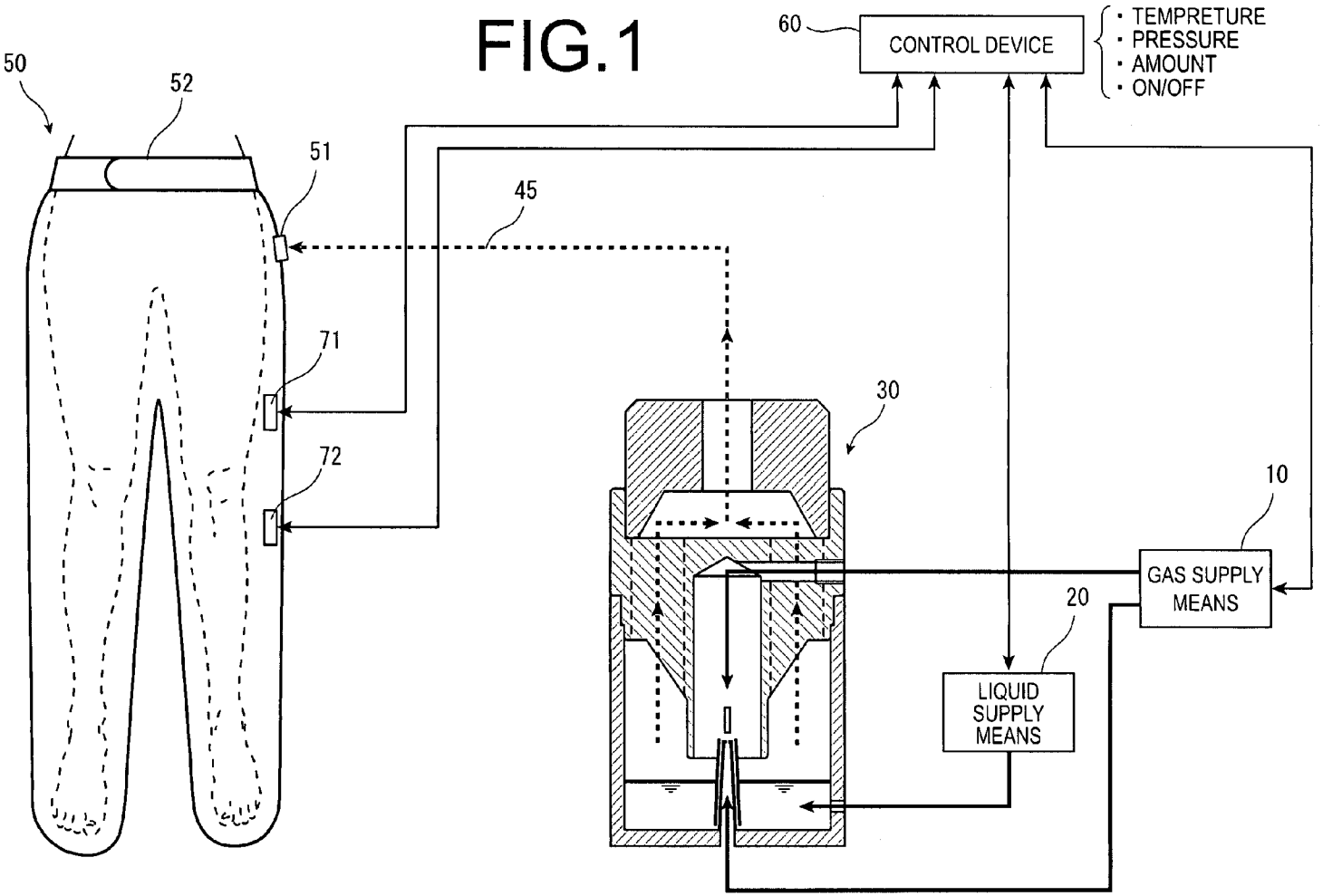
FIG. 1 A generally schematic view of the gas mist pressure bathing system depending on a first embodiment of the invention.

FIG. 1 is the generally schematic view of the gas mist pressure bathing system depending on the first embodiment of this invention. As shown in this illustration, the gas mist pressure bathing system of the present embodiment comprises gas supply means 10 for supplying oxygen or carbon dioxide, or the mixed gas (called briefly as "gas" hereafter) of oxygen and carbon dioxide, liquid supply means 20 for supplying a liquid as a medicine, a gas mist generator gas mist generator 30 serving as the gas mist generating means, a pressurizing cover 50 for the living organism (called as "the living organism-pressure bathing cover" hereafter) serving as the means covering the living organism, and a control device (controlling means) 60.

The gas supply means 10 supplies, as later mentioned, gas to a nozzle 34 of the gas mist generator 30 and a gas supply portion 39. This gas supply means 10 is provided with a regulator for adjusting pressure of gas, though not illustrated. There may be equipped a heater for heating gas and a temperature gauge for controlling temperature.

By the way, herein illustrated is an example of one gas supply means 10 supplying gas to both of a nozzle 34 of the gas mist generator 30 and a gas supply portion 39, and also it is enough to furnish a plurality of gas supply means 10 for supplying gas to the nozzle 34 and the gas supply portion 39 from respectively different gas supply means 10. At this time, gases to be supplied may be different or the same.

The liquid supply means 20 is composed of such as a pump, and supplies the liquid to the gas mist generator 30. As the liquid to be supplied, it is preferable to employ water, ionic water, ozone water, physiological salt solution, purified water, or sterilized and purified water. Further, these liquids are sufficient to contain medicines useful to users' diseases or symptom. As the medicines, for example, listed are anti-allergic agent, anti-inflammatory, anti-febrile agent, anti-fungus agent, anti-influenza virus agent, anti-influenza vaccine, steroid agent, anti-cancer agent, anti-hypertensive agent, cosmetic agent, or trichogen. Further, these liquids are further possible to generate synergistic effects by coupling with a gas physiological action with single or plurality of menthol having a cooling action; vitamin E accelerating circulation of the blood; vitamin C derivative easily to be absorbed to a skin tissue and having a skin beautifying effect; retinol normalizing a skin heratinizing action and protecting the mucous membrane; anesthetic moderating irritation to the mucous membrane; cyclodextrin removing odor; photocatalysis or a complex of photocatalysis and apatite having disinfection and anti-phlogistic; hyaluronic acid having excellent water holding capacity and a skin moisture retention effect; coenzyme Q10 activating cells and heightening immunization; a seed oil containing anti-oxidation and much nutrient; or propolith having anti-oxidation, anti-fungus, ant-inflammatory agent, pain-killing, anesthetic, and immunity. Otherwise, the liquids may be added with ethanol, gluconic acid chlorohexizine, amphoteric surface active agent, benzalkonium chloride, alkyldiamino ether glycin acetate, sodium hypochlorite, acetyl hydroperoxide, sodium sesqui-carbonate, silica, povidone-iodine, sodium hydrogen carbonate. In addition, high density carbonate spring may be added (as examples organic components, sulfate, carbonate, sodium dichloroisocyanurate).

This liquid supply means 20 is, though not illustrating, desirably disposed with a heater for heating the liquid or a temperature gauge for controlling temperature.

Figure 2:
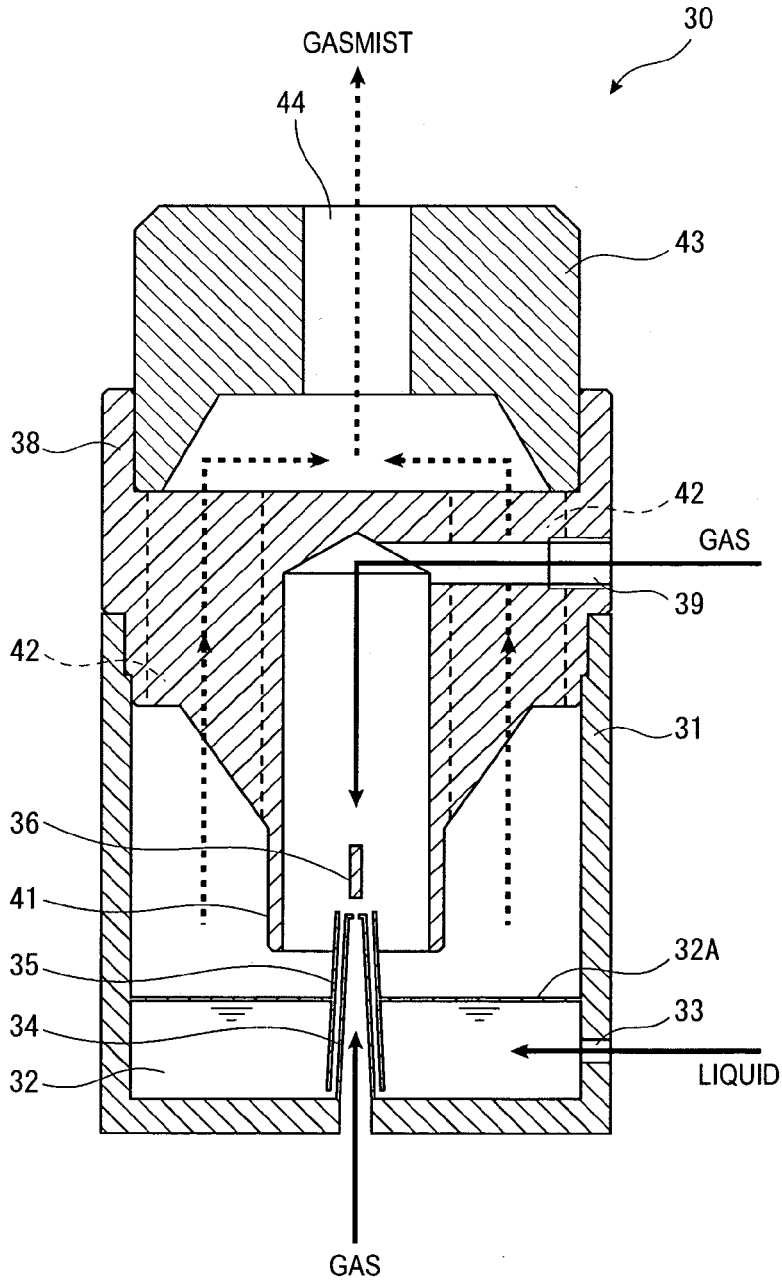
FIG. 2 A cross sectional and typical view showing the structure of the gas mist generator of the gas mist pressure bathing system of the invention.

The gas mist generator 30 stores inside the liquid supplied from the liquid supply means 20, generates the gas mist by pulverizing and dissolving the liquid and gas owing to a high speed flowing gas from the gas supply means 10, and supplies it to the living organism-pressure bathing cover 50. FIG. 2 is the cross sectional and typical view showing the structure of the gas mist generator 30. As shown in FIG. 2, the gas mist generator 30 is composed with a generator main body 31, a center member 38 and a cover member 43. Preferably, the gas mist generator 30 is in advance sterilized.

Figure 3:
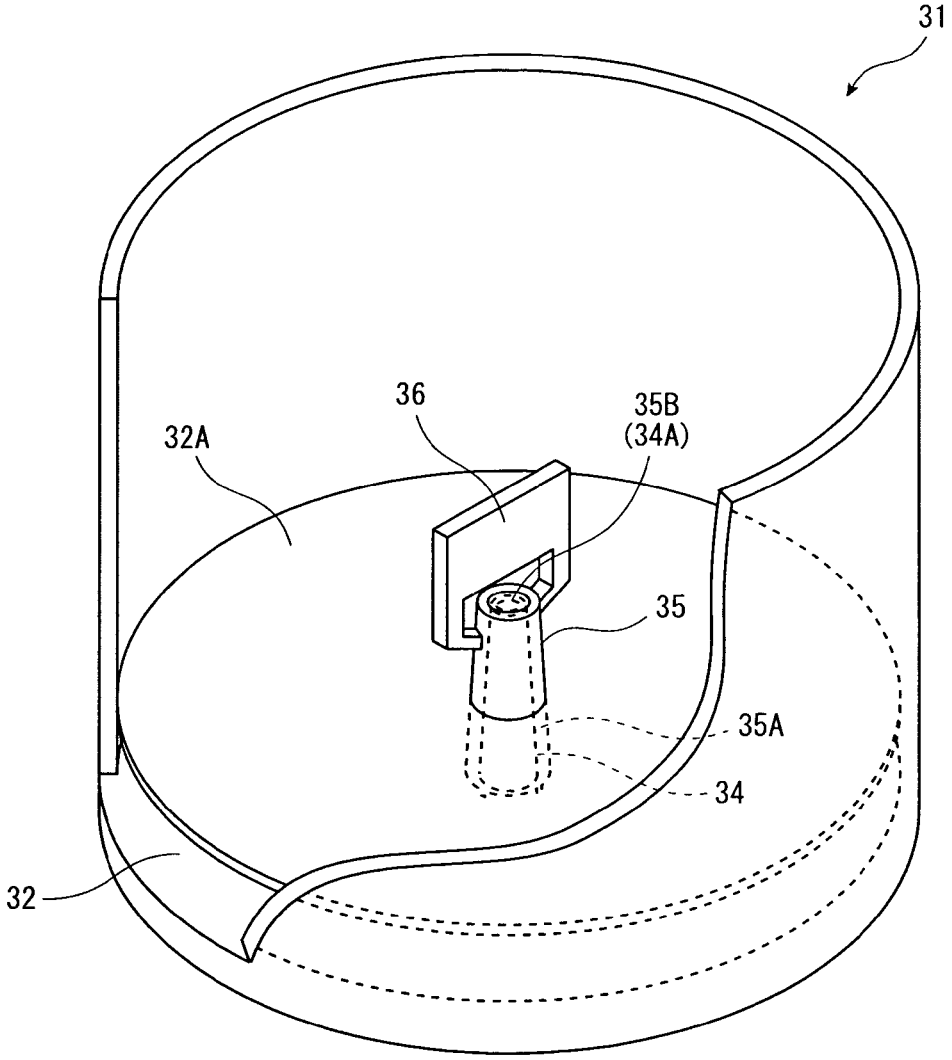
FIG. 3 A perspective view, partially in section, of the generator main body in the gas mist generator shown in FIG. 2.
Figure 4:
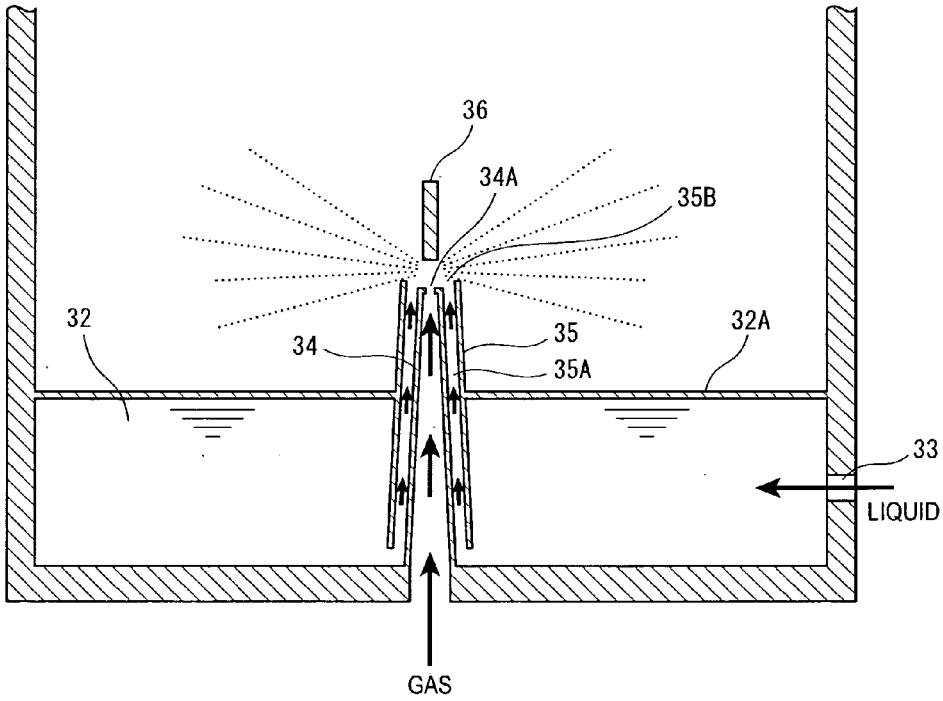
FIG. 4 A cross sectional and typical view of the generator main body in the gas mist generator shown in FIG. 2.

The details of the generator main body 31 are shown in FIGS. 3 and 4. FIG. 3 is the perspective view, partially in section, of the generator main body 31, and FIG. 4 is the cross sectional and typical view of the same. As shown therein, the generator main body 31 is furnished with a liquid storage 32 storing the liquid, a liquid supply port 33 for supplying the liquid from the liquid supply means 20 into the liquid storage 32, a nozzle 34 discharging the gas supplied from the gas supply means 10 out of a front end open 34A, and a liquid suction pipe forming member 35 defining a liquid suction pipe 35A sucking up the liquid stored in the liquid storage 32 up to the front end of the nozzle 34, and a baffle 36 positioned in opposition to the front end open 34A of the nozzle 34.

The liquid storage 32 is formed, as shown in FIGS. 3 and 4, by partitioning the bottom, one part of the side wall of the generator main body 31, and a shielding sheet 32A. This shielding plate 32A serves to force up the liquid upward of the liquid sucking pipe 35A by maintaining pressure in the liquid storage 32 highly than pressure in the upper part from the shielding sheet 32A. Therefore, the shielding plate 32A may be positioned fixedly at a predetermined position of an inner wall of the generator main body 31, otherwise may be vertically movable in response to the level of a liquid surface in the liquid storage 32. Further, depending on magnification of gas pressure discharged from the front end open 34A of the nozzle 34, the shielding plate 32A may not be furnished.

At the bottom center of the generator main body 31 (the liquid storage 32), a nozzle 34 is placed. This nozzle 34 passes through the bottom of the liquid storage 32, and is shaped to be almost circular cone toward an upper side of the generator main body 31. The nozzle 34 is connected at its base end to the gas supply means 10 outside of the present device, and can discharge the gas from its front end open 34A. The basic end of the nozzle 34 is connected to the gas supply means 10 directly or via a tube, and this connecting portion is desirably composed by such as a connector which is connectable by one-touch.

The liquid suction pipe 35A is defined between the outer circumference of the nozzle 34 and the inner circumference of the liquid suction pipe forming member 35 of the almost circular cone being larger by a turn than the nozzle 34. That is, as shown in FIG. 4, by positioning as covering the liquid suction pipe forming member 35 over the nozzle 34, the liquid suction pipe 35A is defined between the outer circumference of the nozzle 34 and the inner circumference of the liquid suction pipe forming member 35. At this time, since a nail shaped projection (not showing) is provided at a base end of the liquid suction pipe forming member 35, a space is formed at a base of the liquid suction pipe forming member 35 and the bottom of the liquid storage 32, so that the liquid stored in the liquid storage 32 is drawn up from this space by the liquid suction pipe 35A. In addition, the front end 35B of the liquid suction pipe forming member 35 opens nearly the front end open 34A of the nozzle 34, and the liquid drawn up by the liquid suction pipe 35A collides against the gas flow discharged from the nozzle 34.

The baffle 36 is a member disposed at a position in opposition to the front end open 34A and the front end 35B of the liquid suction pipe forming member 35 of the nozzle 34, and in the present embodiment, this is fixedly supported to the liquid suction pipe forming member 35. Otherwise, the baffle 36 is sufficient to be fixedly supported to the shielding plate 32A and the inside of the generator main body 31. The liquid suction pipe forming member 35 is connected to the shielding plate 32A at the nearly central part in the vertical directions. The shielding plate 32A is also connected at its outer circumference to the inside of the generator main body 31. Thus, desirably, the generator main body 31 is formed integrally as a whole.

Figure 5:
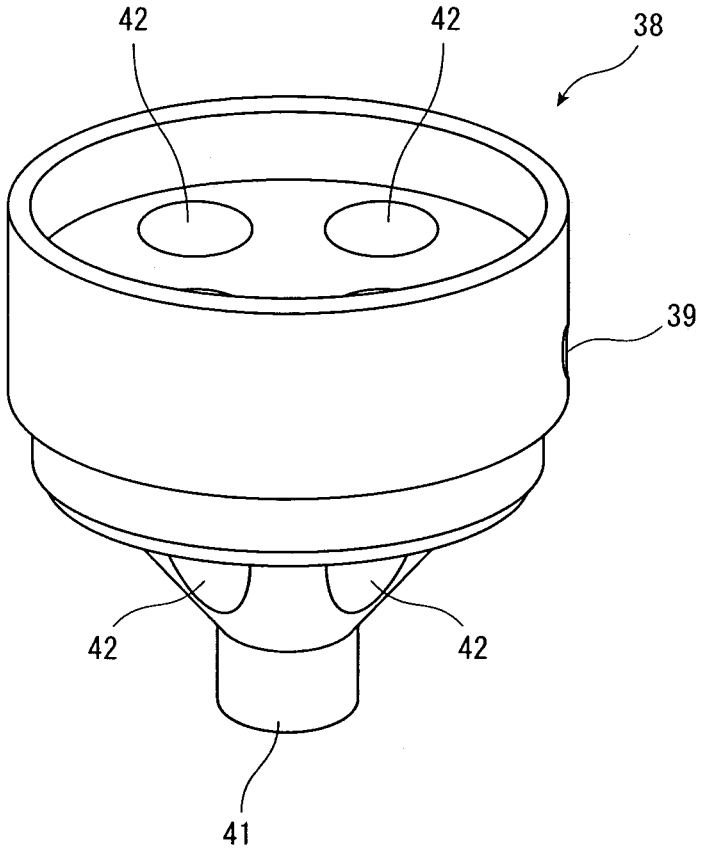
FIG. 5 A perspective view of a center member in the gas mist generator shown in FIG. 2.
Figure 6:
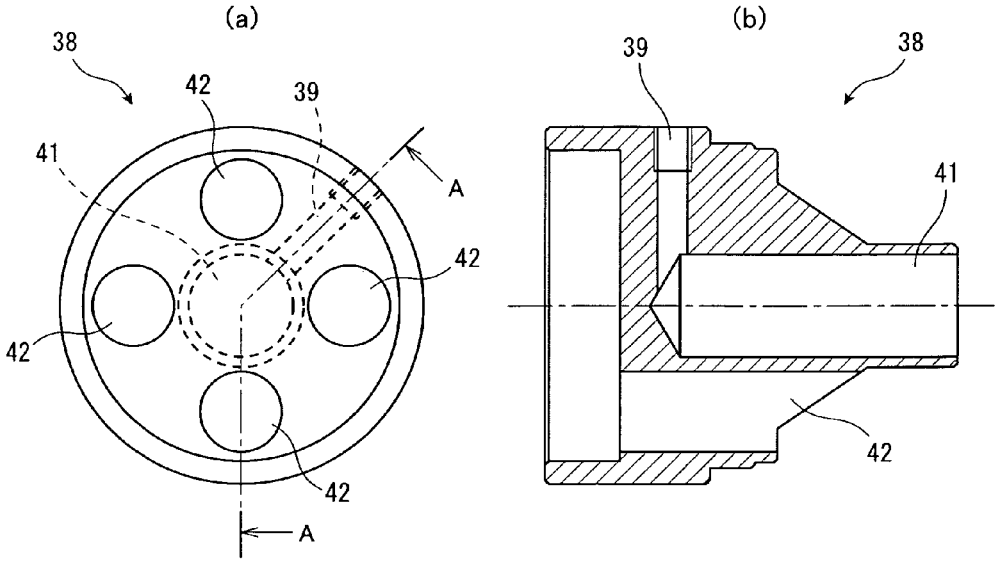
FIG. 6 An upper view and a cross sectional view of the center member in the gas mist generator shown in FIG. 2.

A center member 38 is placed at the central position of the generator main body 31 and a cover member 43, and this is a member of collecting the gas mist generated by the generator main body 31, discharging it to a gas mist supply pipe 45, and supplying the gas into the generator main body 31 so as to heighten supply pressure of the gas mist to the living organism-pressure bathing cover 50. The center member 38 is shown in details in FIGS. 5 and 6. FIG. 5 is a perspective view of the center member 38, FIG. 6(*a*) is an upper view of the same, and FIG. 6(*b*) is an A-A cross sectional view of FIG. 6(*a*).

As shown in these illustrations, the center member 38 is shaped as a spinning top which has a gas supply portion 39 of supplying the gas into the gas mist generator 30, a gas introduction portion 41 of generating an air current for introducing the gas into the generator main body 31 as well as discharging the gas mist, and a gas mist collecting portion 42 of collecting the gas mist and discharging it to the gas mist supply pipe 45.

The gas supply portion 39 is a pipe-shaped hole which is almost perpendicularly connected and is horizontally provided with respect to a gas introduction portion 41. The gas from the gas supply means 10 is supplied into the generator main body 31 via the center member 38 from the gas supply portion 39. The gas introduction portion 41 is a pipe-shaped hole which is disposed in a vertical direction extending as covering the gas mist generated parts (a nozzle front end open 34A, a front end 35B of the liquid sucking pipe, and baffle 36), and which introduces the gas to the gas mist generated part, thereby to discharge efficiently the gas mist from the inside of the generator main body 31. As is seen, separately from the nozzle 34, a gas introducing means of introducing the gas into the gas mist generator 30 is composed of the gas supply portion 39 and the gas introduction portion 41.

On the other hand, the gas mist collecting portions 42 are one or a plurality (herein, four as an example) of pipe shaped holes formed vertically in positions not crossing with the gas supply portion 39 and the gas introduction portion 41, and they lead the air current of the gas mist into a gas mist leading portion 44 of the cover member 43 positioned on the upper part of the center member 38, this gas mist being generated by introducing the gas from the gas introduction portion 41 into the generating part of the gas mist.

On the upper part of the center member 38, the cover member 43 is placed. The cover member 43 is provided with the gas mist leading portion 44, to which a gas mist supply pipe 45 is connected.

The gas mist generated by the gas mist generator 30 is supplied into the living organism-pressure bathing cover 50 from the gas mist supply pipe 45 connected to the gas mist leading portion 44. The gas mist supply pipe 45 is connected to the gas mist leading portion 44 and to the gas mist supply port 51 of the living organism-pressure bathing cover 50. The gas mist port pipe 45 is, though not showing, furnished with a filter for removing liquid drops attaching to the inside of the pipe, and may be provided inside with a check valve for preventing back flow of the gas mist.

Figure 7:
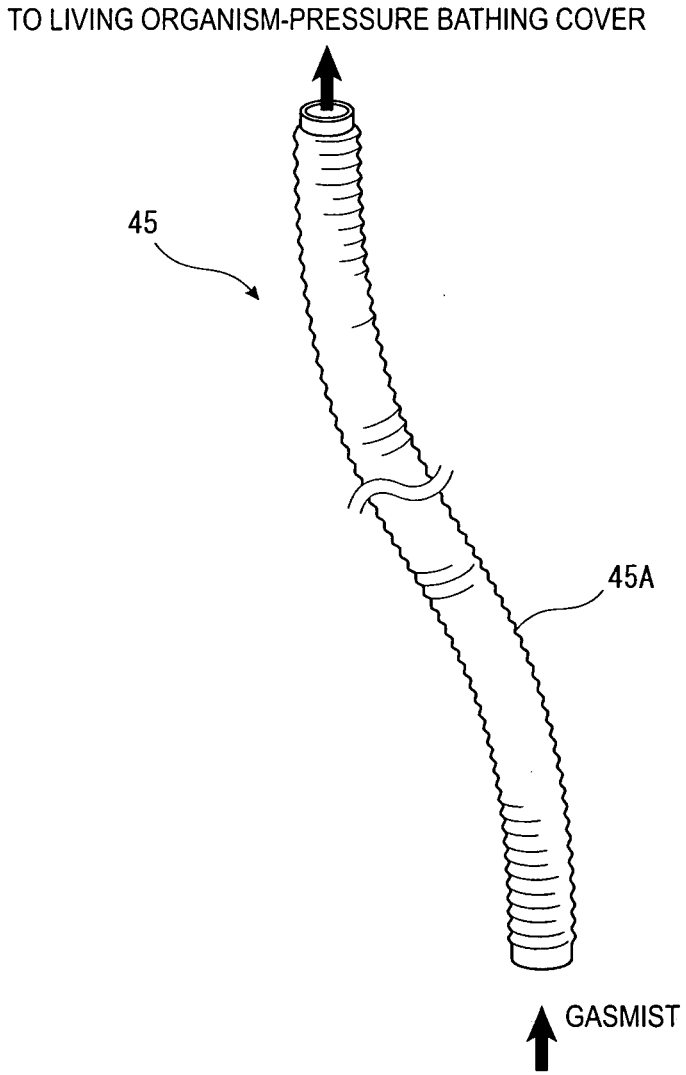
FIG. 7 A typical view showing the example of the gas mist supply pipe connecting the gas mist generator and the pressurizing cover for the living organism of the invention.

Further, if the gas mist supply pipe 45 is overall or partially composed of a soft cornice shaped pipe 45A of a large diameter as shown in FIG. 7, it may be freely bent and may be expanded so that a user of this system is not restricted in his actions. Even if the gas mist flowing in the gas mist supply pipe 45 becomes gradually liquefied, the cornice removes the attached liquid with its concave and convex.

By the way, although, in the above mentioned structure, the liquid in the liquid storage 32 is supplied from the liquid supply means 20, it is permitted to omit the liquid supply means 20 and previously contain the liquid (such as medicines) in the liquid storage 32. In this case, the liquid may be poured before using, otherwise it is sufficient to use the gas mist generator 30 having been poured with the liquid at a manufacturing stage of the gas mist generator. In such a case of the gas mist generator 30 having in advance contained the liquid, after using, only the gas mist generator 30 is removed and it may be wasted. Thus, by making disposable, the gas mist pressure bathing can be hygienically taken.

The living organism-pressure bathing cover 50 enables to form a space for covering the skin and mucous membrane of the living organism (herein, as the example, the lower extremity of the living organism) and to seal the gas mist inside. As an example, FIG. 1 shows a shape as trousers covering the lower extremity of the living organism. The living organism-pressure bathing cover 50 is composed of a water resistant, non-air permeable and non-moisture permeable material, for example, preferably, the natural rubber, silicone rubber, polyethylene, poly-propylene, polyvinylidene, poly stylene, polyvinylacetate, polyvinyl chloride, polyamide resin, polytetrafluoroethylene.

The living organism-pressure bathing cover 50 is connected to the gas mist supply pipe 45 and has the supply port 51 introducing the gas mist inside. The gas mist supply port 51 is provided inside with the check valve to prevent from back-flow of the gas mist. The living organism-pressure bathing cover 50 may have an open or a valve enabling to discharge the gas mist for controlling inside pressure. The pressure control may be performed manually, but desirably automatically based on measuring values of a later mentioned manometer 71 by a control device 60 together with supply or control of the gas and the gas mist. Further, a safety valve (by-pass valve) may be provided for automatically opening the valve when the inside of the pressure bathing cover 50 becomes more than a constant pressure.

The living organism-pressure bathing cover 50 is inside installed with the manometer 71 for measuring internal pressure. The control device 60 controls generation or supply of the gas mist on the basis of measuring values of the manometer 71 for maintaining a pressure value within the living organism-pressure bathing cover 50 to be more than 1 air pressure (more preferably, around 1.02 to 2.5 air pressure). For example, supply of the gas from the gas supply means 10 is controlled or stopped, otherwise, the gas mist or gas is discharged from the living organism-pressure bathing cover 50. Further, the living organism-pressure bathing cover 50 is inside installed with a temperature gauge 72 for measuring a temperature within the living organism-pressure bathing cover 50. The control device 60 performs on-off of a heater installed in the liquid supply means 21 on the basis of measuring values of the temperature gauge 72 for maintaining a determined temperature (for example, around 38° C.) bringing about warm bath effects within the living organism-pressure bathing cover 50.

The living organism-pressure bathing cover 50 has, around its opening, a stopper 52 for attaching to and detaching from the living organism (herein, as the example, the lower extremity of the living organism) and for preventing leakage of the gas mist. The stopper 52 is suitably composed of, e.g., a face fastener of stretching property, or may have a sole, string, rubber or their combination. For heightening a sealing property of the living organism-pressure bathing cover 50, the inside (such as an inside of the stopper 53) thereof may have a material attaching to the user's skin. The adhesive material is preferably, for example, a visco-elastic gel made of polyurethane or silicone rubber. Further this adhesive material is detachably used and exchangeable each time or if viscosity becomes weak.

The control device 60 is composed of a computer having CPU, memory and display. This device 60 performs various kinds of controls for carrying out the gas mist pressure bath under the optimum condition, such as pressure control, on-off switch of supply, temperature control of the liquid of the liquid supply means 20, on-off switch of supply. In particular, preferably, when the pressure value becomes more than a predetermined value in the living organism-pressure bathing cover 50, such a structure stops supplying the gas from the gas supply means 10 by the control device 60.

Next, reference will be made to one example of sequences taking the gas mist pressure bathing by use of the gas mist pressure bathing system of the present embodiment.

At first, the living organism-pressure bathing cover 50 is fixedly secured to the living organism (herein, as the example, the lower extremity of the living organism) and closed. Next, the liquid of a determined amount is poured into the liquid storage 32 of the gas mist generator 30 from the liquid supply means 20. Subsequently, the gas is supplied into the gas mist generator 30 from the gas supply means 10.

When the gas is supplied into the nozzle 34, since the nozzle 34 is, as shown in FIG. 4, reduced in diameter toward the front end as seeing in FIG. 4, the gas increases flowing speed and is discharged. The liquid is sucked up from the liquid sucking pipe 35A by negative pressure generated owing to air current at this time, spouted up at the front end 35B of the liquid sucking pipe 35A and it runs against the baffle 36, and the mist is generated. Desirably, diameter of the mist generated by this collision is fine, and concretely, less than 10 μm is optimum. The finely pulverized mist can display effects of minus ion. The gas is supplied into the generator main body 31, as needed, also from the gas supply portion 39 and the gas introduction portion 41 to increase discharging pressure of the generated gas mist. During generating the gas mist; the control device 60 carries out adjustments of the supplying pressure, amount or temperature of the liquid and the gas.

The generated gas mist is discharged into the living organism-pressure bathing cover 50 from the gas mist supply pipe 45. At this time, preferably, in the living organism-pressure bathing cover 50, the gas is controlled to exist about 95 to 97%, while the liquid is controlled to exist about 3 to 5%. In the mist, desirably, the gas is dissolved at the density of 40 ppm, and the size of the air bubble is around 232 pm. The control device 60 adjusts each of the steps from the measuring values of the manometer 71 and the temperature gauge 72, such that the inside of the living organism-pressure bathing cover 50 is optimum pressurized and heated condition (around 1.02 to 2.5 air pressure and around 38° C.), and under this condition, the gas mist pressure bath is carried out.

The above mentioned explanation has been made to the lower extremities of the human living organism as the example to be performed, and the invention is applicable to various parts for taking the gas mist pressure bathing. Then, an optimum gas mist pressure bathing is performed by using the shapes of the living organism-pressure bathing cover 50 meeting object parts of the living organism.

Figure 8:
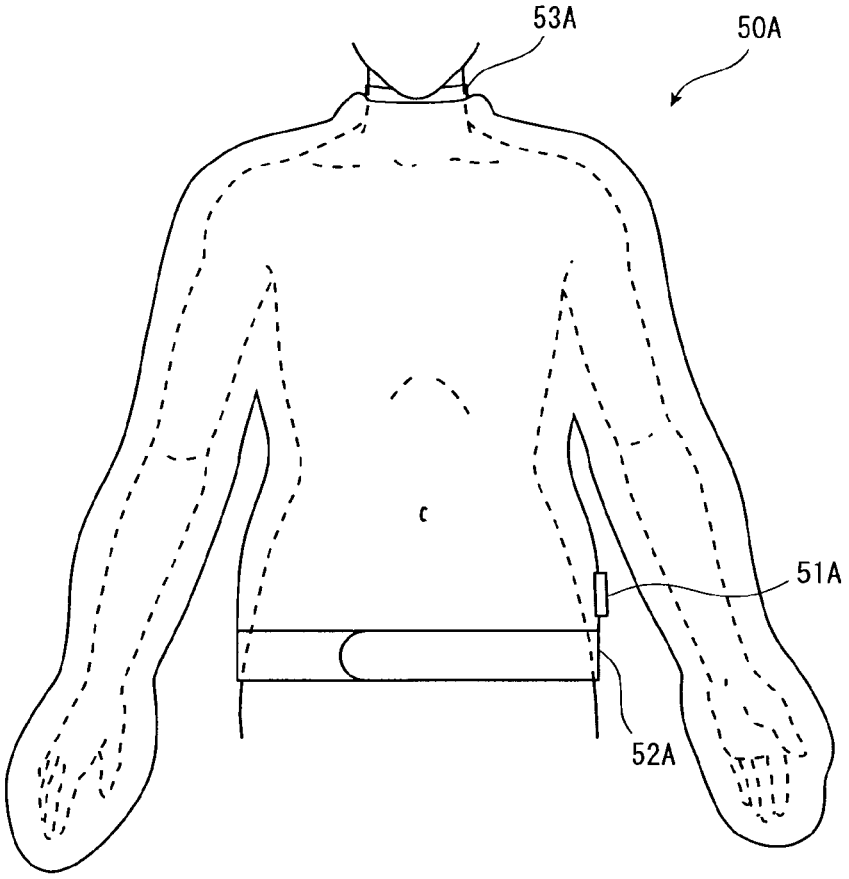
FIG. 8 A typical view showing a configuration example (No. 1) of the pressure bathing cover for the pressurizing cover for the living organism in the gas mist pressure bathing system depending on the first embodiment of the invention.
Figure 9:
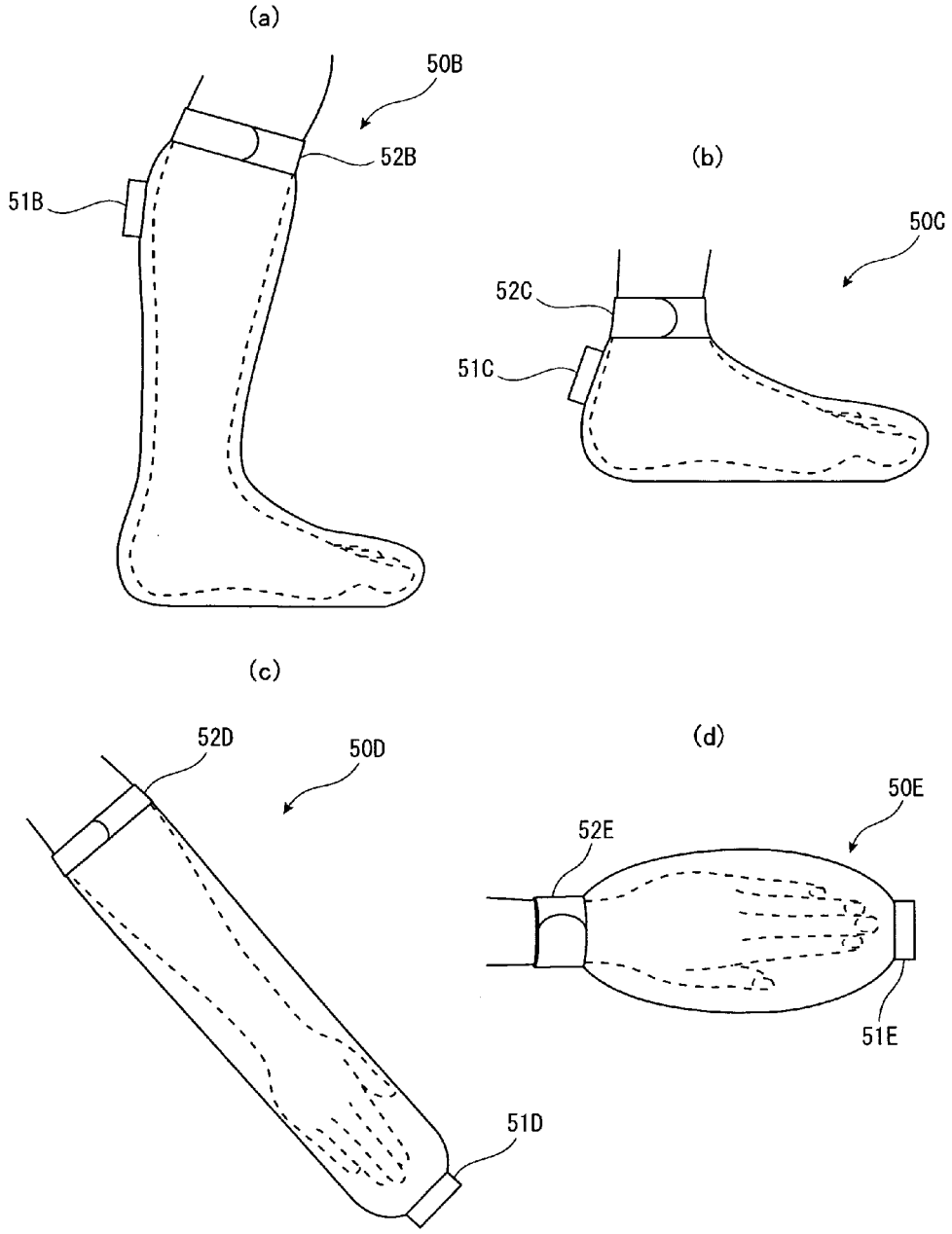
FIG. 9 A typical view showing a configuration example (No. 2) of the pressure bathing cover for the pressurizing cover for the living organism in the gas mist pressure bathing system depending on the first embodiment of the invention.
Figure 10:
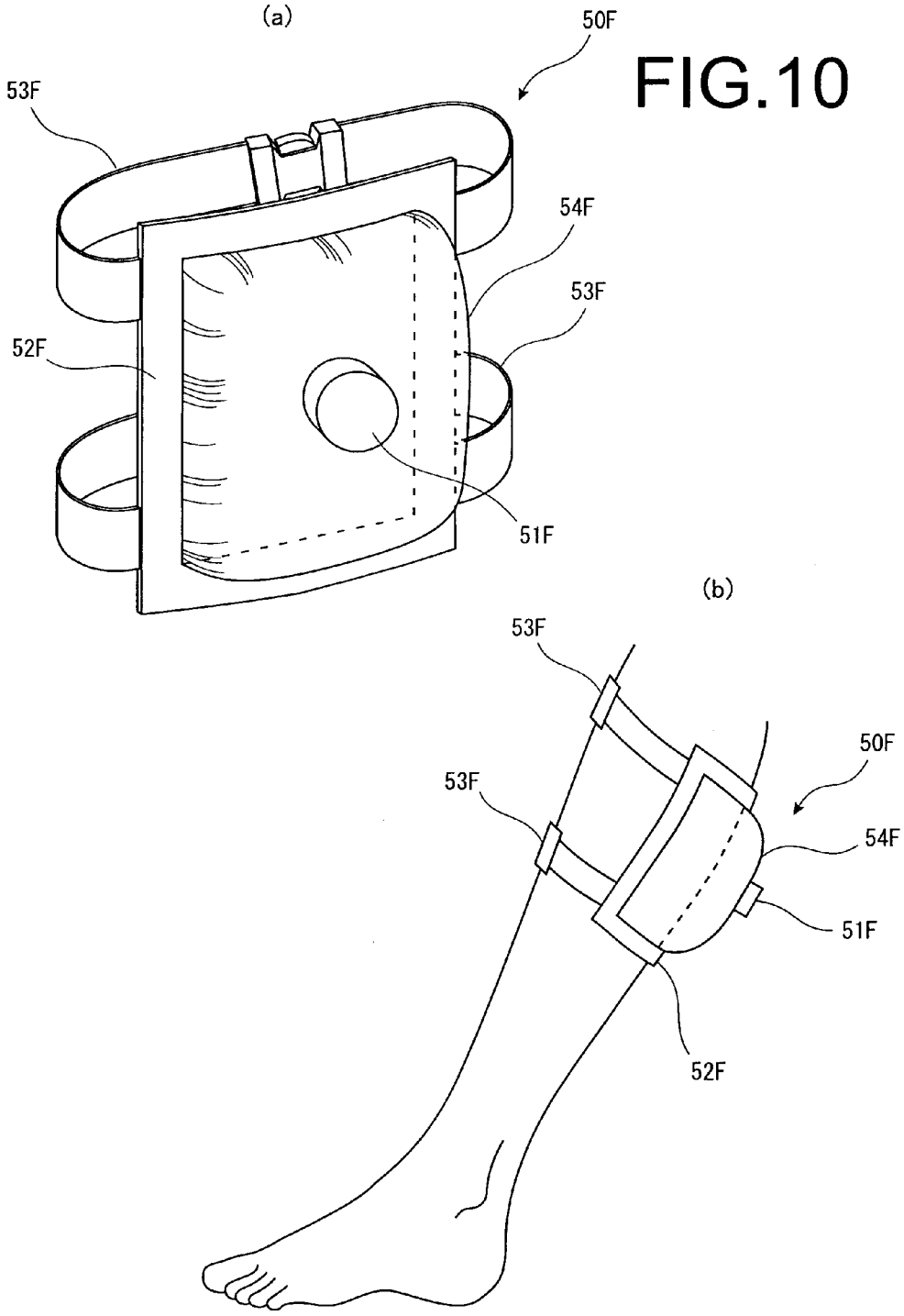
FIG. 10 A typical view showing a configuration example (No. 3) of the pressure bathing cover for the pressurizing cover for the living organism in the gas mist pressure bathing system depending on the first embodiment of the invention.

FIGS. 8 to 10 show the various shaped examples of the living organism-pressure bathing cover 50. At first, FIG. 8 shows the schematic view of the pressure bathing cover 50A for the upper half of the living organism. The pressure bathing cover 50A has a shape for wrapping the whole of the upper half of the living organism, and has a stopper 53A for attaching to and detaching from the living organism when opening a waist part and stopping leakage of the gas mist. A stopper 53A is similarly formed around the opening of a neck. 51A designates a supply port for introducing inside the gas mist.

FIG. 9 shows the various shaped examples of the living organism-pressure bathing cover 50 for covering further limited parts. FIG. 9(*a*) is the pressure bathing cover 50B for one-side lower extremity (lower part under a knee) of the living organism. The pressure bathing cover 50B has the stopper 52B at its opening part and a supply port 51B for introducing inside the gas mist. FIG. 9(*b*) is the pressure bathing cover 50C for feet. The pressure bathing cover 50C has a stopper 52C at its opening part and a supply port 51C for introducing inside the gas mist. FIG. 9(*c*) is the pressure bathing cover 50D for a forearm. The pressure bathing cover 50D has a stopper 52D at its opening part and a supply port 51D for introducing inside the gas mist. FIG. 9(*d*) is the pressure bathing cover 50E for a hand. The pressure bathing cover 50E has a stopper 52E at its opening part and a supply port 51E for introducing the gas mist inside thereof.

Further, FIG. 10 shows a patch shaped pressure bathing cover 50F. FIG. 10(*a*) is a view showing the outline of the patch shaped pressure bathing cover 50F. FIG. 10(*b*) is a view showing an external appearance when attaching the patch shaped pressure bathing cover 50F to the living organism (herein, the lower extremity). The pressure bathing cover 50F is composed of a cover part 54F for covering the skin and mucous membrane of the living organism, a stopper 52F provided at the margin of the cover part 54F and directly attached to the skin and mucous membrane, a supply port 52F for supplying the gas mist into the space defined by the cover 54F and the stopper 52F, and fasteners 53F made of belts or strings for fastening the cover part 54F to the living organism.

In regard to the living organism-pressure bathing cover 50, other than the examples shown in FIGS. 8 to 10, various shapes may be assumed. In particular, the invention may be applied not only to the human living organism but also to animals, and therefore, also as to the living organism-pressure bathing cover 50, shapes are employed to meet using objects and parts. In sum, if forming the space for sealing inside the gas mist, any shape is sufficient. It is desirable, though not illustrating, to furnish an air discharge port for discharging the gas mist from the inside of the living organism-pressure bathing cover 50 for controlling pressure.

In the gas mist pressure bathing, depending on the living organism-pressure bathing cover 50, the gas mist is contacted to the skin and mucous membrane of the living organism at pressure more than the determined value, and such pressure heightens effects by pulse-like shaping performance of a determined interval. Therefore, the control device 60 may supply the gas mist into the living organism-pressure bathing cover 50 on and off at constant rhythm. Intervals of interval pressure at this time can heighten the effect by synchronizing pulsations.

Second Embodiment

Figure 11:
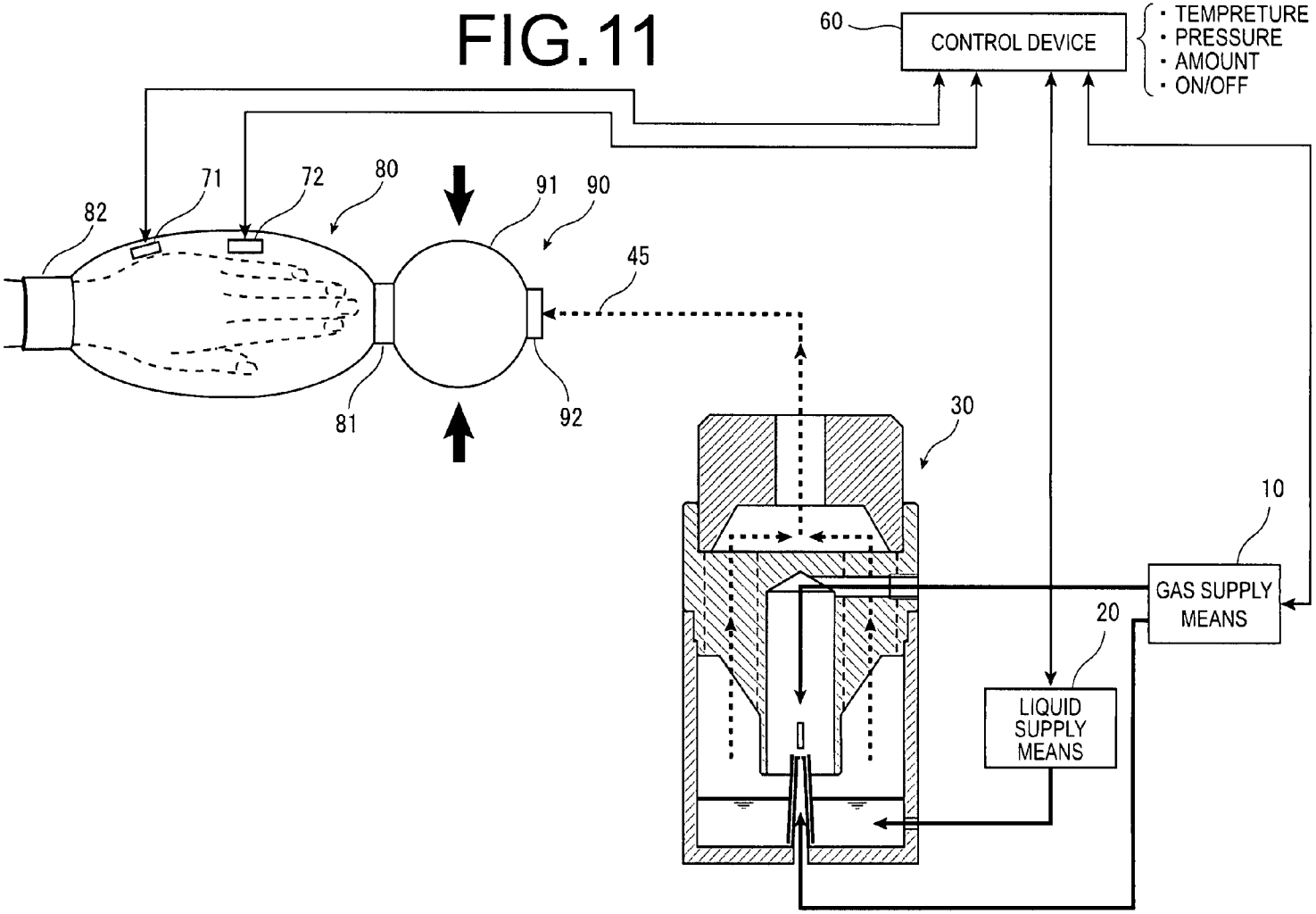
FIG. 11 A generally schematic view of the gas mist pressure bathing system depending on a second embodiment of the invention.

FIG. 11 is the generally schematic view of the gas mist pressure bathing system depending on the second embodiment of this invention. This embodiment will explain the gas mist pressure bathing system further having a means for making easy pressurization within the living organism-pressure bathing cover. As to the same parts as those of the first embodiment shown in FIG. 1, the same numerals will be given, and detailed explanation will be omitted.

As shown in FIG. 11, the gas mist pressure bathing system of this embodiment has the living organism-pressure bathing cover 80 forming a space of sealing inside the gas mist and the pressurizing means 90 pressurizing the inside of the living organism-pressure bathing cover 80.

The living organism-pressure bathing cover 80 is substantially the same in the structure as the living organism-pressure bathing cover 50 shown in the first embodiment, and this has the gas mist supply port 81 and the stopper 82, providing that the supply port 81 is connected with the pressurizing means 90. By the way, the example herein shows the living organism-pressure bathing cover 80 of a shape covering the hand of the living organism.

The pressurizing means 90 pressurizes the inside the living organism-pressure bathing cover 80, and therefore has a hollow gas storage 91 communicating the living organism-pressure bathing cover. The gas storage 91 is composed of a soft material having pressure-proof, non-air permeability and non-moisture permeability. The pressurizing means 90 is connected to the supply port 81 of the living organism-pressure bathing cover 80, and has a supply port 92 from which the gas mist is supplied into the gas storage 91. In addition, the gas mist supply port 92 of the pressurizing means 90 is also provided inside with the check valve for checking back-flow of the gas mist.

For pressurizing the living organism-pressure bathing cover 80 by the pressurizing means 90, the gas mist is stored in the gas storage 91 under a condition where the gas mist is moderately stored within the living organism-pressure bathing cover 80. When the gas storage 91 is pressurized as crashed as shown with arrows in FIG. 11, the gas mist in the gas storage 91 is discharged into the living organism-pressure bathing cover 80, so that the inside of the living organism-pressure bathing cover 80 can be pressurized.

The pressurizing means 90 is enough with a structure of manually pushing, or sufficient to mechanically control by the control device 60 using a driving device. As mentioned above, pressure heightens effects by pulse-like shaping performance of a determined interval.

When taking the gas mist pressure bathing by use of the gas mist pressure bathing system of this embodiment, at first, the living organism-pressure bathing cover 80 is fixed to the living organism (herein, the hand) and closed. Next, the liquid of a determined amount is poured into the liquid storage 32 of the gas mist generator 30 from the liquid supply means 20. Subsequently, the gas is supplied from the gas supply means 10 into the nozzle 34 of the gas mist generator 30 and the gas supply portion 39, and the gas mist is generated. During this time, the control device 60 controls supply pressure, amount or temperature of the liquid and the gas.

The generated gas mist is discharged into the pressurizing means 90 and the living organism-pressure bathing cover 80 from the gas mist supply pipe 45. At this time, preferably, in the living organism-pressure bathing cover 80, the gas is controlled to exist about 95 to 97%, while the liquid is controlled to exist about 3 to 5%. In the mist, desirably, the gas is dissolved at the density of 40 ppm, and the size of the air bubble is around 232 pm. The control device 60 adjusts each of the steps from the measuring values of the manometer 71 and the temperature gauge 72 such that the inside of the living organism-pressure bathing cover 80 is optimum pressurized and heated condition (for example, around 38° C.), and under this condition the gas mist pressure bath is carried out. When the gas mists of the optimum amount are stored in the living organism-pressure bathing cover 80 and the pressurizing means 90, the pressurizing means 90 is pushed to moderately pressurize (around 1.02 to 2.5 air pressure) the living organism-pressure bathing cover 80 for taking the gas mist pressure bathing.

As having mentioned in the first embodiment, various shapes of the living organism-pressure bathing covers 80 may be employed, since they are applied to many parts of the living organism, providing that in the present embodiment, the living organism-pressure bathing cover 80 must have a size easily pressurized by the pressurizing means 90. For example, when manually pressurizing the pressurizing means 90, the pressurizing means 90 must have such a size grasped by a man's both hands, and the living organism-pressure bathing cover 80 pressurized with the pressurizing means 90 is also limited in size, accordingly. Further, even if, in a case of pressurizing with the driving device, the pressurizing means 90 and a means pressurizing it are desirably compact not to actually keep wide places, therefore, the present embodiment is applicable to the living organism-pressure bathing cover 80 which is comparatively compact (covering local parts of the living organism).

Figure 12:
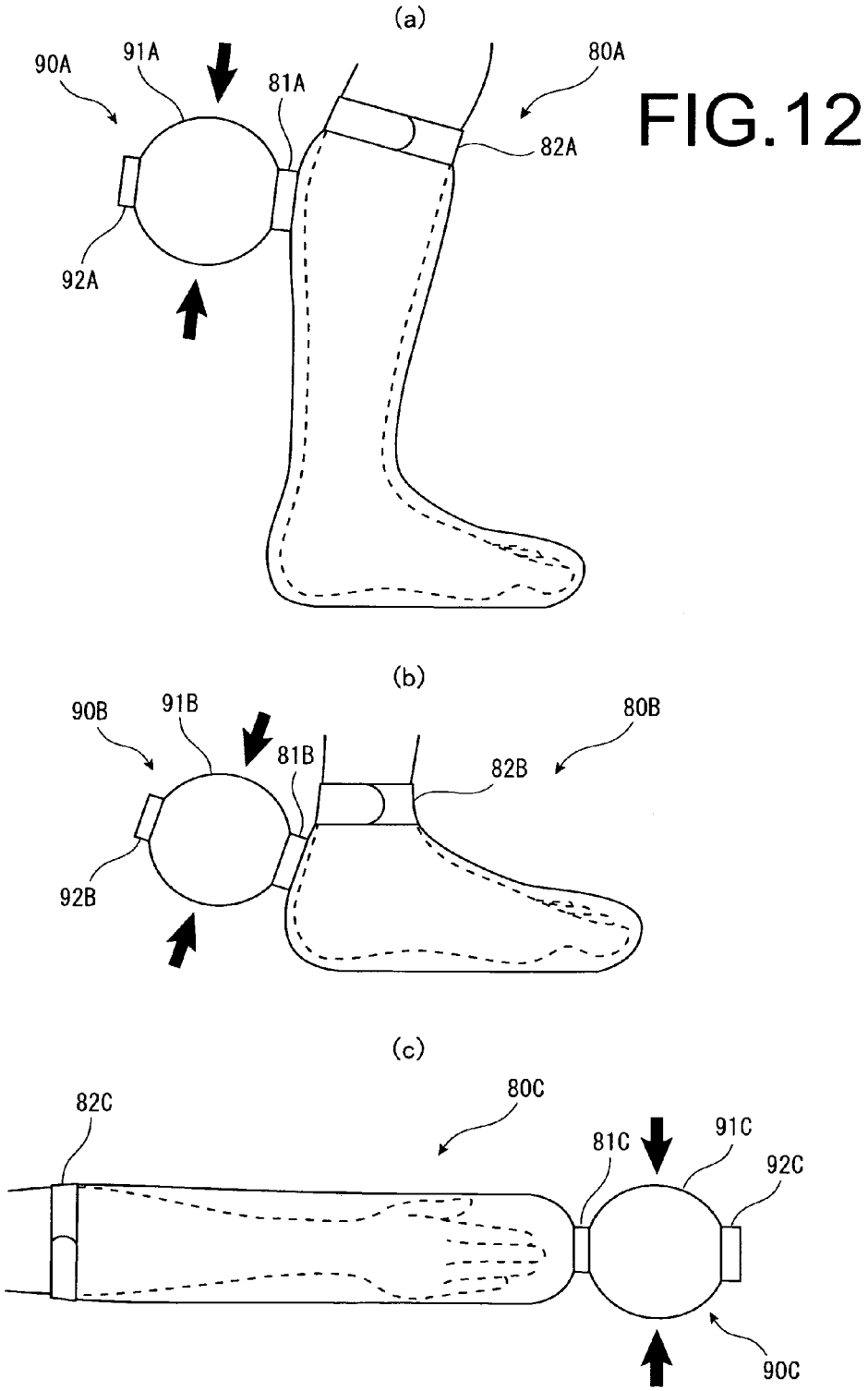
FIG. 12 A typical view showing a configuration example (No. 1) of the pressure bathing cover for the pressurizing cover for the living organism in the gas mist pressure bathing system depending on the second embodiment of the invention.
Figure 13:
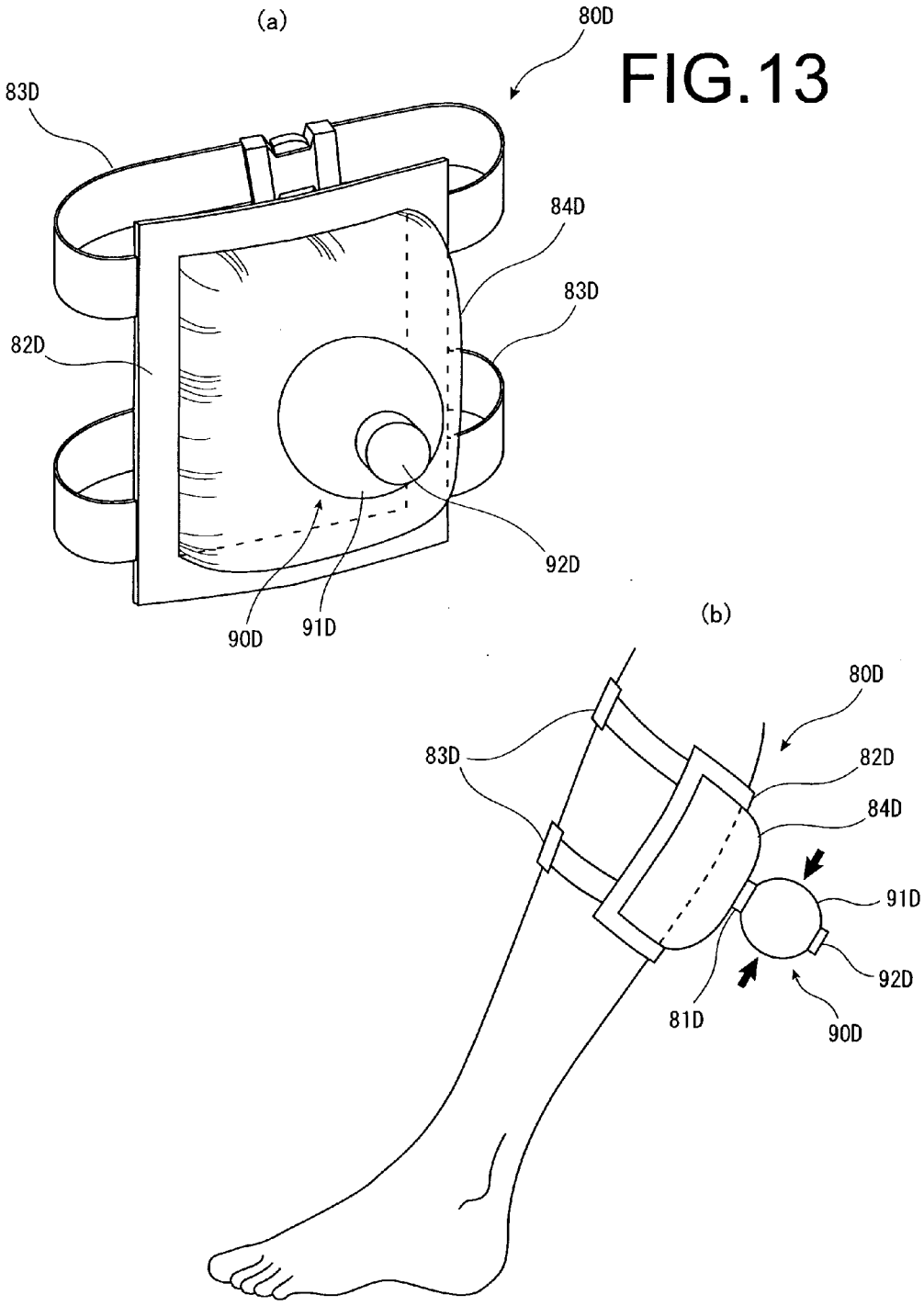
FIG. 13 A typical view showing a configuration example (No. 2) of the pressure bathing cover for the pressurizing cover for the living organism in the gas mist pressure bathing system depending on the second embodiment of the invention.

FIGS. 12 and 13 show the examples of shapes of the living organism-pressure bathing cover 80 to which the present embodiment is easily applied and of the pressurizing means 90 to be connected thereto. FIG. 12(*a*) is the pressure bathing cover 80A for one-side lower extremity (lower part under a knee) of the living organism. The pressure bathing cover 80A has the supply port 81A for introducing inside the gas mist stopper 53B and the stopper 82A at its open. The supply port 81A is connected to the pressurizing means 90A. The pressurizing means 90A has a gas storage 91A and supply port 92A. FIG. 12(*b*) is the pressure bathing cover 80B for feet. The pressure bathing cover 80B has a supply port 81B for introducing inside the gas mist and a stopper 82B at its opening part. The supply port 81B is connected with the pressurizing means 90B. The pressurizing means 90B has a gas storage 91B and a supply port 92B. FIG. 12(*c*) is the pressure bathing cover 80C for a forearm. The pressure bathing cover 80C has a supply port 81C for introducing inside the gas mist and a stopper 82C at its opening part. The supply port 81C is connected with the pressurizing means 90C. The pressurizing means 90C has a gas storage 91B and a supply port 92C.

FIG. 13 shows a patch shaped pressure bathing cover 80D. FIG. 13(*a*) is a view showing the outline of the patch shaped pressure bathing cover 80D. FIG. 13(*b*) is a view showing an external appearance when attaching the patch shaped pressure bathing cover 80D to the living organism (herein, the lower extremity). The pressure bathing cover 80D is composed of a cover part 84D for covering the skin and mucous membrane of the living organism, a stopper 82D provided at the margin of the cover part 84D and directly attached to the skin and mucous membrane, fasteners 83D made of belts or strings for fastening the cover part 84D to the living organism, and a supply port 81D for supplying the gas mist into the space defined by the cover 84D and the stopper 82D. The supply port 81D is connected with the pressurizing means 90D. The pressurizing means 90D has the gas storage 91D and the supply port 92D.

Incidentally, although having not shown here, preferably there is provided an discharge port for discharging the gas mist within the living organism-pressure bathing cover 80 or adjusting pressure.

In the above embodiment, the pressurizing means 90 is composed of the hollow gas storage 91 communicating to the living organism-pressure bathing cover 80, and any members are sufficient if enabling to conveniently pressurize the living organism-pressure bathing cover 80 such as a member compressing to crash the living organism-pressure bathing cover 80 from an outer periphery.

Third Embodiment

Figure 14:
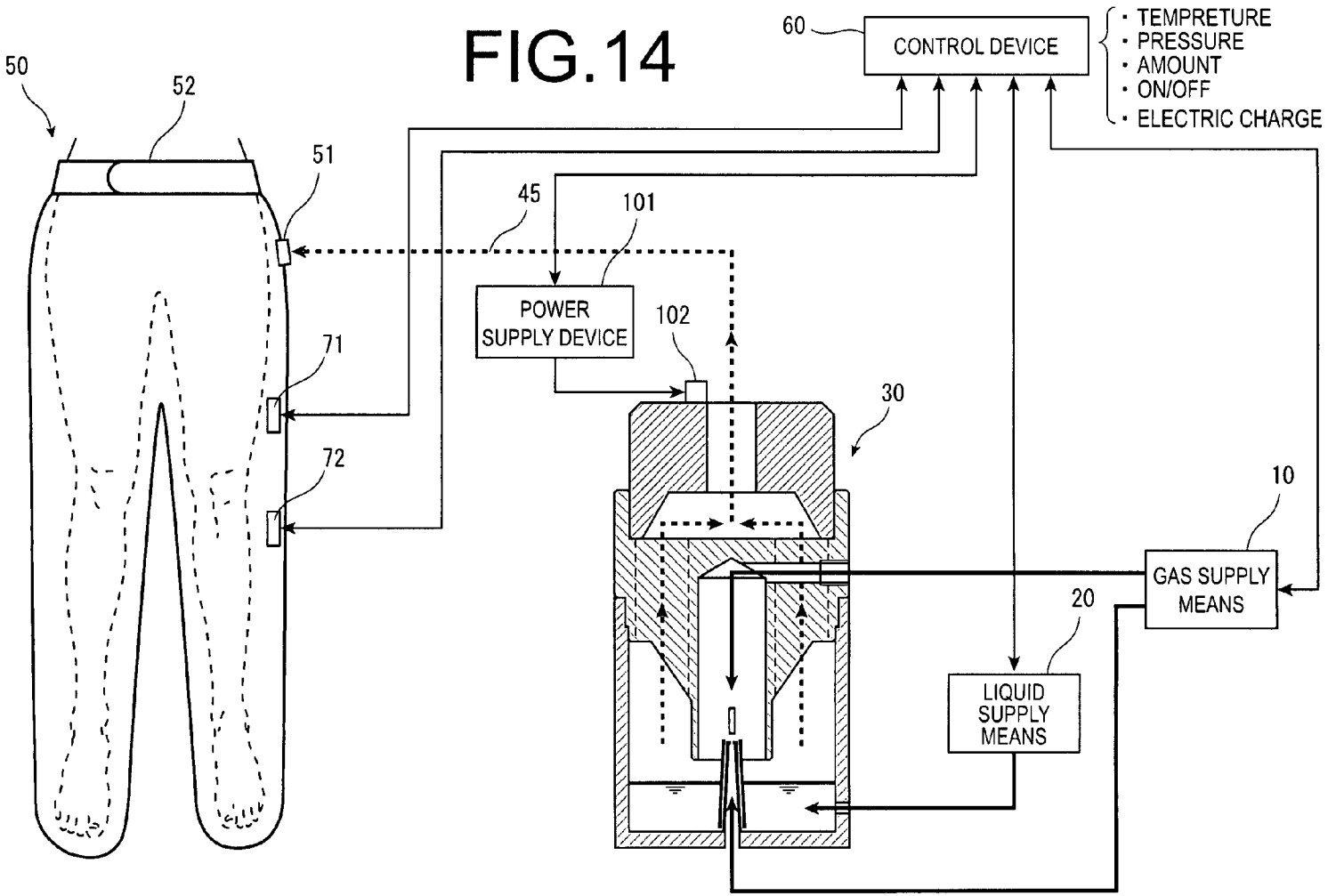
FIG. 14 A generally schematic view of the gas mist pressure bathing system depending on a third embodiment of the invention.

FIG. 14 is the generally schematic view of the gas mist pressure bathing system depending on the third embodiment of this invention. This embodiment will explain the gas mist pressure bathing system further having a means for electrically charging the generated mist. As to the same parts as those of the first embodiment shown in FIG. 1, the same numerals will be given, and detailed explanation will be omitted.

As shown in FIG. 14, the gas mist pressure bathing system 2 of this embodiment is arranged with an electrode 102 in the vicinity of an exit of a gas mist leading portion of the gas mist generator 30. The electrode 102 is connected to a power supply device 101, and the control device 60 sets voltage values and performs on-off control.

The electrode 102 supplies an electric charge (minus charge is desirable) when discharging the mist generated by the gas mist supply device 30. Thereby, the mist is made charged so that adhesion to a charged material can be heightened. For example, if heightening adhesion to the skin and the mucous membrane of the living organism, an effect of more increasing absorption rate of the gas by the mist is further heightened, and if the mist contains the above mentioned medicines, penetration into the skin and the mucous membrane can be accelerated.

For carrying out the gas mist pressure bathing by using the gas mist pressure bathing system of the present embodiment, the pressure bathing cover 50 is fixedly secured to the living organism (herein, as the example, the lower extremity) and closed. Next, the liquid of a determined amount is poured into the liquid storage 32 of the gas mist generator 30 from the liquid supply means 20. Subsequently, gas is supplied from the gas supply means 10 into gas mist supply device 31 to generate the gas mist. The control device 60 performs controls of gas supplying pressure or liquid temperature. If necessary, the regulator 41 is opened and closed to regulate supplying pressure of the gas mist. Further, the control device 60 turns on a power supply device 101 and gives an electric charge to the mist from the electrode 102.

The generated gas mist is discharged from the gas mist supply pipe 45 into the living organism-pressure bathing cover 50. At this time, preferably, in the living organism-pressure bathing cover 50, the gas is controlled to exist about 95 to 97%, while the liquid is controlled to exist about 3 to 5%, and desirably, in the mist, the gas is dissolved in the density of about 40 ppm, and the size of its air bubble is about 232 pm. The control device 60 is controlled such that the inside of the living organism-pressure bathing cover 50 becomes the optimum pressurized and heated conditions (around 1.02 to 2.5 air pressure and around 38° C.), and under this condition the gas mist pressure bathing is carried out.

Fourth Embodiment

Figure 15:
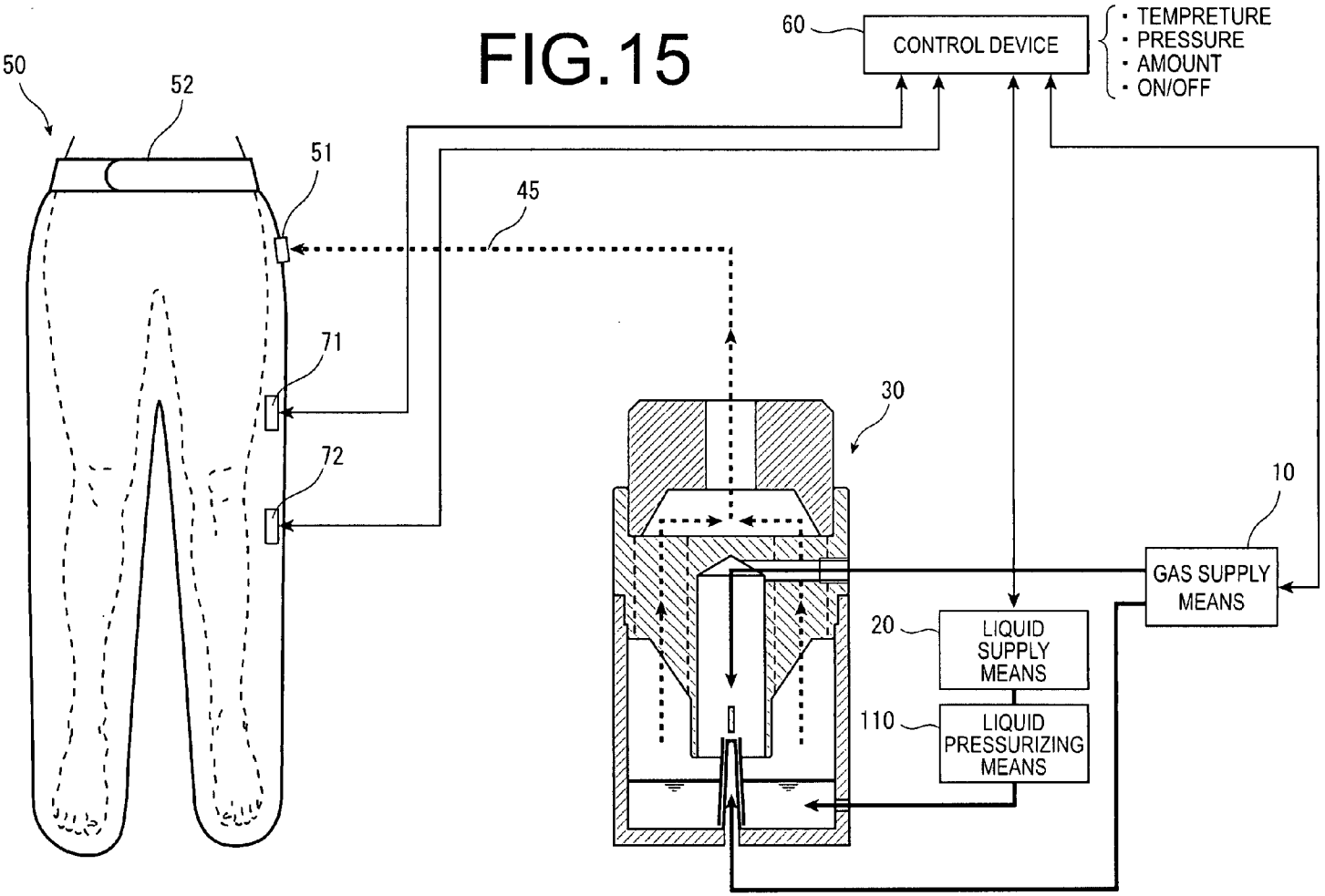
FIG. 15 A generally schematic view of the gas mist pressure bathing system depending on a fourth embodiment of the invention.

FIG. 15 is the generally schematic view of the gas mist pressure bathing system depending on the fourth embodiment of this invention. This embodiment will explain the gas mist pressure bathing system further having a liquid pressurizing means of pressurizing the liquid from the liquid supply means and sending to the gas mist generator. As to the same parts as those of the first embodiment shown in FIG. 1, the same numerals will be given, and detailed explanation will be omitted.

As shown in FIG. 15, in the present gas mist pressure bathing system, the liquid pressurizing means 110 is disposed for pressurizing the liquid and sending it to the gas mist generator 30. The liquid pressurizing means 110 is composed of such as a pump for pressurizing the liquid from the liquid supply means 20 and sending to the liquid storage 32 of the gas mist generator 30. By pressurizing the liquid as this manner, it makes easy to pressurize and supply of the gas mist by the gas mist generator 30. Pressurization and supply by the gas mist generator 30 are carried out by the control device 60.

For carrying out the gas mist pressure bathing by using the gas mist pressure bathing system of the present embodiment, the pressure bathing cover 50 is fixedly secured to the living organism (herein, as the example, the lower extremity) and closed. Next, the liquid of a determined amount is poured into the liquid storage 32 of the gas mist generator 30 from the liquid supply means 20. Subsequently, while the gas is supplied from the gas supply means 10 into the nozzle 34 of the gas mist generator and the gas supply portion 39, the gas is supplied under pressure into the liquid storage 32 from the liquid pressurizing means 110 in order to generate the gas mist. In the meantime, the control device 60 performs controls of gas supplying pressure or liquid temperature.

The generated gas mist is discharged from the gas mist supply pipe 45 into the living organism-pressure bathing cover 50. At this time, preferably, in the living organism-pressure bathing cover 50, the gas is controlled to exist about 95 to 97%, while the liquid is controlled to exist about 3 to 5%, and desirably, in the mist, the gas is dissolved in the density of about 40 ppm, and the size of its air bubble is about 232 pm. The control device 60 is controlled such that the inside of the living organism-pressure bathing cover 50 becomes the optimum pressurized and heated conditions (around 1.02 to 2.5 air pressure and around 38° C.), and under this condition the gas mist pressure bathing is carried out.

With the structure as mentioned above, according to the gas mist pressure bath system of the invention, since it is possible to control the amount, pressure and other of the gas mist within the pressure bathing cover for the living organism by the control device, the gas mist pressure bath can be always carried out under the optimum condition.

Since gas mist can be generated with the very simple structure, reduction of cost of the present device can be realized.

Further, pressurization within the living organism-pressure bathing cover is easy, and the gas skin-pass absorption can be more efficiently performed.

The above explanation has been made to the embodiments of the invention, but the invention is not limited thereto, and so far as not deviating from the subject matter of the invention, various kinds of embodiments are, of course, available.

INDUSTRY APPLICABILITY

Thus, the present invention relates to the gas mist pressure bath device, in which the gas mist is prepared by pulverizing and dissolving the gas and the liquid, and the gas mist is directly contacted to the skin or mucous membrane of the living organism at pressure more than the predetermined value, and has an industrial applicability.

REFERENCE SIGNS LIST

10: gas supply means
20: liquid supply means
30: gas mist generator
31: generator main body
32: liquid storage
32A: shielding sheet
33: liquid supply port
34: nozzle
34A: nozzle front end open
35: liquid sucking pipe-forming member
35A: liquid sucking pipe
35B: front end of the liquid sucking pipe
36: baffle
38: center member
39: gas supply portion
41: gas introduction portion
42: gas mist collecting portion
43: cover member
44: gas mist leading portion
45: gas mist supply pipe
45A: cornice shaped pipe
50, 50A, 50B, 50C, 50D, 50E, 50F: pressure bathing cover for the living organism, or living organism-pressure bathing cover
51, 51A, 51B, 51C, 51D, 51E, 51F: gas mist supply port
52, 52A, 52B, 52C, 52D, 52E, 52F, 53A: stopper
53F: holders
54F: cover
60: control device
71: manometer
72: temperature gauge
80, 80A, 80B, 80C, 80D: pressure bathing cover for the living organism, or living organism-pressure bathing cover
81, 81A, 81B, 81C, 81D: gas mist supply port
82, 82A, 82B, 82C, 82D: stopper
83D: holders
84D: cover
90, 90A, 90B, 90C, 90D: pressurizing means
91, 91A, 91B, 91C, 91D: gas storage
92, 92A, 92B, 92C, 92D: gas mist supply port
101: power supply device
102: electrode
110: liquid pressurizing means

The invention claimed is:

1. A gas mist pressure bathing system, which prepares a gas mist by pulverizing and dissolving a gas including carbon dioxide or oxygen or a mixed gas of carbon dioxide and oxygen and a liquid, and causes the gas mist to directly contact skin and mucous membrane of a living organism at a density of not less than a predetermined value, comprising:

gas supply means for supplying the gas, gas mist generating means having a liquid storage disposed inside thereof for storing the liquid, a nozzle for supplying the gas supplied from the gas supply means under pressure and discharging said gas, and a liquid sucking pipe for sending the liquid from the liquid storage to a front end of the nozzle, the gas mist generating means generating the gas mist at a vicinity of a front end of the liquid sucking pipe and the front end of the nozzle, a covering member for the living organism covering the skin and mucous membrane of the living organism and formed with a space for sealing inside the gas mist supplied from the gas mist generating means, sensors for measuring supplying conditions of the gas, liquid and gas mist, and control means for controlling supplying conditions of the gas, liquid and gas mist based on measured values of the sensors, wherein the gas mist generating means further comprises gas introduction means disposed at a position separate from the nozzle, for supplying the gas into the gas mist generating means where the gas mist is generated, and generating an air current guiding the gas mist to the living organism covering member to increase supplying pressure of the gas mist into the living organism covering member.

2. The gas mist pressure bathing system as set forth in claim 1, further comprising pressurizing means connected to the living organism covering member for pressurizing the inside of the living organism covering member.

3. The gas mist pressure bathing system as set forth in claim 2, wherein the pressurizing means is connected to the living organism covering member and has a hollow gas storage to discharge the gas mist into the living organism covering member.

4. The gas mist pressure bathing system as set forth in claim 3, wherein the pressurizing means discharges the gas on and off into the living organism covering member, thereby to effect interval pressurization in the living organism covering member.

5. The gas mist pressure bathing system as set forth in claim 1, wherein the control means supplies the gas mist on and off into the living organism covering member, thereby to effect interval pressurization in the living organism covering member.

6. The gas mist pressure bathing system as set forth in claim 1, further comprising liquid supply means for supplying the liquid to the liquid storage.

7. The gas mist pressure bathing system as set forth in claim 6, further comprising liquid pressurizing means for pressurizing the liquid from the liquid supply means and supplying to the gas mist generating means.

8. The gas mist pressure bathing system as set forth in claim 1, wherein the liquid is any one of or a combination of water, ionic water, ozone water, physiological salt solution, purified water, or sterilized and purified water.

9. The gas mist pressure bathing system as set forth in claim 8, wherein the liquid further contains any one of or a combination of menthol, vitamin E, vitamin C derivative, retinol, anesthetic agent, cyclodextrin, photocatalyst, complex of photocatalyst and apatite, hyaluronic acid, coenzyme Q10, seed oil, propolith, ethanol, chlorhexidine gluconate, amphoteric surface active agent, benzalkonium chloride, alkyldiamino etherglycine acetate, sodium hypochlorite, peracetic acid, sodium sesquicarbonate, silica, povidone-iodine, sodium hydrogen carbonate, carbonate spring agent of high density, anti-allergic agent, anti-inflammatory agent, anti-febrile agent, anti-fungus agent, anti-influenza virus agent, influenza vaccine, steroid agent, anti-cancer agent, anti-hypertensive agent, and cosmetic.

10. The gas mist pressure bathing system as set forth in claim 1, wherein a size of the mist supplied from the gas mist generating means into the living organism covering member is not more than 10 μm.

11. The gas mist pressure bathing system as set forth in claim 1, wherein the control means holds pressure at 1.02 to 2.5 atmosphere in the living organism covering member when taking a pressure bath of the gas mist.

12. The gas mist pressure bathing system as set forth in claim 1, further comprising electric charge supply means for supplying electric charge to the gas mist from the gas mist generating means.

13. The gas mist pressure bathing system as set forth in claim 12, wherein the electric charge is minus.

14. The gas mist pressure bathing system as set forth in claim 1, wherein the gas mist generating means has a gas mist supply pipe for supplying the gas mist into the living organism covering member, and the gas mist supply pipe includes a filter for removing liquid drops attaching to the inside of the pipe.

15. The gas mist pressure bathing system as set forth in claim 1, wherein the gas mist generating means has a gas mist supply pipe for supplying the gas mist into the living organism covering member, and the gas mist supply pipe is composed of a cornice shaped pipe over a whole or at one part thereof.

16. The gas mist pressure bathing system as set forth in claim 1, wherein the gas mist generating means has a gas mist supply pipe for supplying the gas mist into the living organism covering member, and the gas mist supply pipe is provided with a check valve.

17. The gas mist pressure bathing system as set forth in claim 1, wherein the living organism covering member comprises a gas mist supply port with a check valve.

18. The gas mist pressure bathing system as set forth in claim 1, wherein the control means stops the gas from the gas supply means when a pressurizing value within the living organism covering member is higher than a predetermined value.

19. The gas mist pressure bathing as set forth in to claim 1, wherein the gas mist generating means is sterilized in advance.

20. The gas mist pressure bathing system as set forth in claim 1, wherein the gas mist generating means further comprises:

a baffle disposed at the front end of the liquid sucking pipe, for generating the gas mist; and a gas mist collecting portion disposed above the liquid storage, for collecting the gas mist and discharging to the living organism covering member, and the gas mist generating means is configured so that an air current generated from the nozzle generates negative pressure to suck up the liquid from the liquid sucking pipe, the liquid is spouted up to collide with the baffle to generate the gas mist, and the gas mist is collected in the gas mist collecting portion to discharge to the living organism covering member.

* * * * *